United States Patent [19]

Hagstrom

[11] Patent Number: 4,742,794

[45] Date of Patent: May 10, 1988

[54] TRIM TAB INDICATOR SYSTEM

[75] Inventor: David Hagstrom, Endwell, N.Y.

[73] Assignee: Bennett Marine, Inc., Deerfield Beach, Fla.

[21] Appl. No.: 904,672

[22] Filed: Sep. 8, 1986

[51] Int. Cl.[4] ..... B63B 1/22

[52] U.S. Cl. ..... 114/286; 91/1; 92/5 R

[58] Field of Search ..... 114/285, 286, 287; 440/2; 91/1; 92/5 R; 340/689, 870.26

[56] References Cited

U.S. PATENT DOCUMENTS

| | | | |
|---|---|---|---|
| 3,160,836 | 12/1964 | Farley | 91/1 |
| 3,628,487 | 12/1971 | Bennett | 114/287 |
| 3,654,549 | 4/1972 | Maurer et al. | 92/5 R |
| 4,261,278 | 4/1981 | Gaudin | 114/286 X |

FOREIGN PATENT DOCUMENTS

| | | | |
|---|---|---|---|
| 5478 | 5/1979 | European Pat. Off. | 92/5 R |

*Primary Examiner*—Sherman D. Basinger

*Attorney, Agent, or Firm*—Barnes, Kisselle, Raisch, Choate, Whittemore & Hulbert

[57] ABSTRACT

A trim tab indicator system comprising a pair of trim members hinged to the stern of a boat, one of each side of the center line of the boat and a hydraulic cylinder individual to each trim member having a first head at one end and a second head at the other end. The cylinder includes a piston and a tubular shaft connected to the piston and extending through the first end of the cylinder. A bracket is connected to the first head and has a surface complementary to the transom of the boat and is mounted on the transom. A tubular coil is fixed on the first head and extends axially within the cylinder, and a floating rod of magnetically permeable material is provided in the tubular shaft with a lower end engaging the base of the tubular opening of the shaft with its upper end extending into the coil such that movement of the trim tab changes the inductive relationship between the rod and the coil to provide a signal representing the position of the tab.

9 Claims, 2 Drawing Sheets

FIG.3
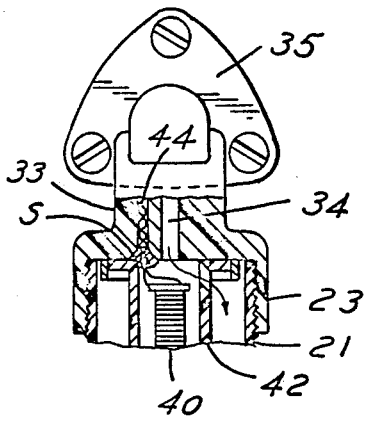
FIG.4
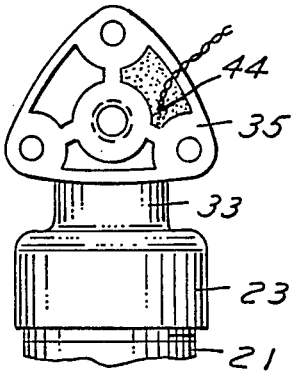
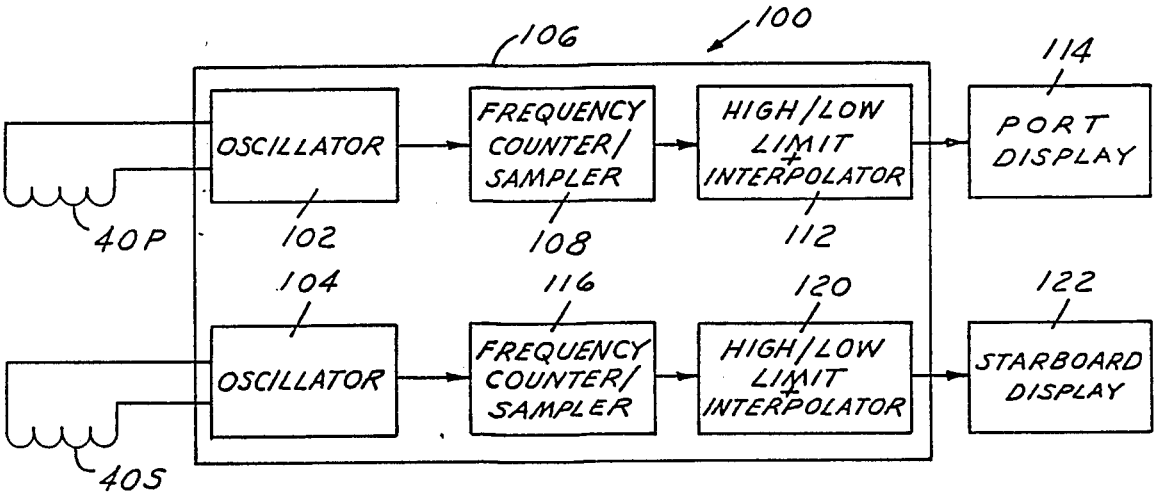
FIG.5

TRIM TAB INDICATOR SYSTEM

This invention relates to trim tabs for power boats and particularly to a trim lab indicator system for indicating the position of the trim tabs.

BACKGROUND AND SUMMARY OF THE INVENTION

In prior U.S. Pat. Nos. 3,062,167, 3,399,643 and 3,628,847 there are disclosed and claimed trim attachments for power boats which comprise trim members or tabs that are hinged to the stern of the boat and are actuated to varying angles to provide control of the attitude of the boat. In U.S. Pat. No. 3,628,487 there is disclosed a hydraulically operated trim attachment comprising a trim tab indicator system comprising a pair of trim members hinged to the stern of a boat, one of each side of the center line of the boat and a hydraulic cylinder individual to each trim member having a head at one end and a head at the other end, and a tubular shaft connected to the piston and extending through the other end of the cylinder. A bracket is connected to the first head and has a surface complementary to the transom of the boat and is mounted on the transom.

It is desirable to be able to indicate continuously the position of the trim tabs.

It has heretofore been suggested that the position of trim tabs can be sensed by providing pickups on the shaft of an electrically motor driven trim tab as shown in U.S. Pat. No. 4,232,626. U.S. Pat. No. 3,641,965 shows a arrangement utilized with stern drives to provide a signal proportional to the angle of tilt of the stern drive. U.S. Pat. No. 4,420,741 shows an electronic position monitor and readout device for trim tabs on boats which functions on the basis of timing the travel of the trim tabs to determine the position.

U.S. Pat. No. 3,160,836 shows cylinders with external position sensors and U.S. Pat. No. 3,654,549 and British Patent No. 1,088,544 (1967) show cylinders with internal devices.

Each of these systems are complex and difficult to make.

Among the objects of the present invention are to provide a trim tab indicator system which is compact; easy to manufacture; is readily adapted to cylinders already in use and which continuously provides a signal indicative of the position of the trim tab.

In accordance with the invention, a tubular coil is fixed on the first head and extends axially within the cylinder, and a floating rod of magnetically permeable material is provided in the tubular shaft with a lower end engaging the base of the tubular opening of the shaft with its upper end extending into the coil such that movement of the trim tab changes the inductive relationship between the rod and the coil to provide a signal representing the position of the tab.

DESCRIPTION OF THE DRAWINGS

FIG. 3 is a fragmentary view taken along the line 3—3 in FIG. 1.

FIG. 4 is a fragmentary rear elevational view of the portion shown in FIG. 3.

FIG. 5 is a functional block diagram of trim tab position sensor and display electronics in accordance with a presently preferred embodiment of the invention.

DESCRIPTION

Figures 1, 2:
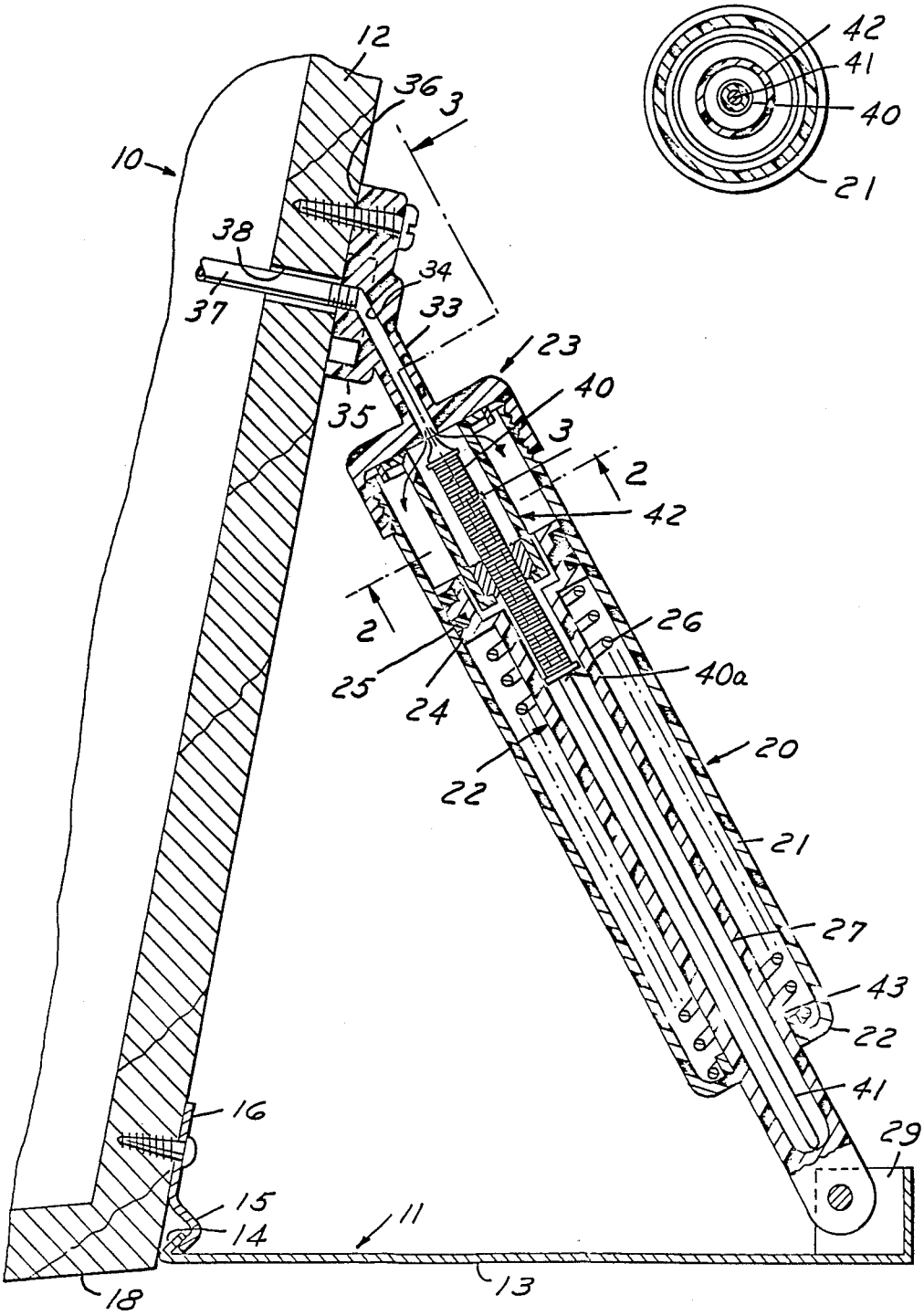
FIG. 1 is a part sectional view of a trim tab indicator system embodying the invention.
FIG. 2 is a sectional view taken along the line 2—2 in FIG. 1.

Referring to FIG. 1, boat 10 has a pair of trim members 11 hinged to the transom 12 in the manner disclosed and claimed in the aforementioned U.S. Pat. Nos. 3,062,167, and 3,399,643. Each of the trim members comprises a generally flat portion 13 having an end 14 which is hooked into the hooked end 15 of a bracket 16 to provide a hinge. Each side of the trim member 11 when in horizontal position is substantially in the plane of the bottom 18 of the boat.

The angle of the trim member with respect to the boat can be varied by use of a hydraulic cylinder 20 comprising a cylindrical body 21 having a lower head 22 integral therewith and an upper head 23 that is threaded thereon. A piston 24 with an O-ring seal 25 is reciprocable within the cylinder and is yieldingly urged upwardly by a spring 26 interposed between the piston 24 and the lower head 22. Hollow piston shaft 27 on piston 24 is pivoted at its lower end to a bracket 29 on trim member 11.

Head 23 includes a generally rectangular interconnecting element or flange 33 having a fluid opening 34 therein and an integral bracket 35 which has a surface 36 for engaging the transom 12. A fluid line 37 extends through an opening 38 in the transom 12 and is threaded into the bracket 35 in an opening 39 which communicates with passage 34.

Fluid can be selectively applied through line 37 to force the piston 24 downwardly in opposition to the spring 26 to force the piston upwardly. The spring functions to hold the tabs horizontal at dockside.

In accordance with the invention, the integral interconnecting element 33 is preferably made of plastic as is the entire head 23 and bracket 35 so that there is limited permissible movement between the head 23 and bracket 35 permitting accommodation for varying angles of the transom 12 as well as changes necessitated by the sweep of the connecting axis at bracket 29 as the angle of the trim tab is varied. A satisfactory plastic material comprises Type 12 nylon made by E. I. Du Pont Company and incorporating glass fibers. The cylindrical body 21, piston 24; piston shaft 27, bracket 29 and pin are preferably made of the same material.

The aforementioned hydraulically operated trim attachment for power boats is disclosed in U.S. Pat. No. 3,628,487 which is incorporated herein by reference.

In accordance with the invention, a tubular wire coil 40 wound about a plastic core **40*a* is mounted within the cylinder 21 by a plastic mounting bracket 42 which has a tubular portion and a flange portion which is snapped into head 23 and held in position by adhesive. The coil 40** is mounted on the bracket at the lower end and supported by a sealant.

Further, in accordance with the invention, an elongated rod 41 of magnetically permeable material, preferably ferrous material, is provided with its upper end extending into the coil 40 and its lower end engaging the base of the opening 42 in the shaft 43 of piston 22 so that the rod floats but in its normal operating position engages the lower end of the opening 42. Alternatively, the rod 41 can be fixed to the piston by adhesive or plastic so that the cylinder will function upside down or at any angle.

As the position of the associated trim tab changes, the rod 42 moves into and out of the coil 40 to a greater or lesser extent. The inductive action between the rod 41 and the coil 40 produces a signal continuously representative of the position of the trim tab.

The lead wires from the coil extend through an opening 44 formed in the interconnecting element 34 and are held in position by sealant S.

FIG. 5 illustrates a presently preferred embodiment 100 of trim tab indicator and display electronics as comprising a pair of relaxation oscillators 102,104 having the coils 40*p* and 40*s* of the port and starboard trim plane cylinders connected in the negative feedback loops such that output frequencies of the respective oscillators vary as independent functions of port and starboard trim plane positions. The output of oscillator 102 is fed to a central processing unit or CPU 106 which includes circuitry 108 for periodically sampling and storing oscillator output frequency. The output of frequency counter/sampler 108 is fed to a high/low limit calibration circuit 112 which stores the highest and lowest values of the frequency counter, and linearly interpolates intermediate outputs therebetween. The output of calibration circuit 112, which thus indicates trim plane position between stored high and low calibration limits, drives a display 114, such as an LCD and/or LED display, for indicating relative position of the port trim tab. Oscillator 104 is likewise fed in CPU 106 through frequency counter/sampler circuit 116 and a high/low limit calibration circuit 120 to a port position display 122. Most preferably, CPU 106 comprises a microprocessor having internal or external ROM for storing suitable programming for performing the signal processing functions hereinabove described.

I claim:

1. A trim tab indicator system comprising a pair of trim members hinged to the stern of a boat, one on each side of the center line of the boat and a hydraulic cylinder individual to each trim member having a first head at one end and a second head at the other end, and a tubular shaft connected to a piston and extending through the other end of the cylinder, a bracket has a surface complementary to the transom of the boat and is mounted on the transom, a tubular coil is fixed to the first head and extends axially within the cylinder, and a rod of magnetically permeable material is mounted within the tubular shaft for movement therewith with its upper end extending into the coil such that movement of the trim member changes the inductive relationship between the rod and the coil to provide a signal representing the position of the tab, said coil is provided with lead wires extending through an opening in said bracket directly through the transom when mounted such that the wires are not exposed outside the boat.

2. A trim tab indicator system comprising a pair of trim members hinged to the stern of a boat, one on each side of the center line of the boat, a hydraulic cylinder individual to each trim member having a first head at one end attached to a trim member and a second head at the other end, a piston, and a tubular shaft connected to the piston and extending through the one end of the cylinder at the first head, a plastic bracket connected to said second head and having a surface complementary to the transom of the boat and adapted to be mounted on the transom of the boat, a tubular coil fixed to the second head and extending axially within the cylinder, and a rod of magnetically permeable material extending within said tubular shaft for movement therewith and having an end extending into the coil such that movement of the trim member changes the inductive relationship between the rod and the coil to provide a signal representing the position of the tab, said bracket having a first opening through said bracket providing fluid communication from the interior of said cylinder through said bracket for attachment of a fluid line through the transom of the boat, said bracket having a second opening extending from the interior of said cylinder through said bracket, said coil having lead wires extending through said second opening, and means holding said lead wires in position in the bracket.

3. The system set forth in claim 2 wherein said tubular shaft having a tubular opening having a base at one end, said rod being floating and the lower end of said rod engaging the base of the tubular opening of the shaft.

4. A trim tab indicator system comprising a trim member hinged to the stern of a boat, a hydraulic cylinder having a first head at one end attached to a trim member and a second head at the other end, a piston, and a tubular shaft connected to the piston and extending through the one end of the cylinder at the first head, a plastic bracket connected to said second head and having a surface complementary to the transom of the boat and adapted to be mounted on the transom of the boat, a tubular coil fixed to the second head and extending axially within the cylinder, and a rod of magnetically permeable material extending within said tubular shaft for movement therewith and having an end extending into the coil such that movement of the trim member changes the inductive relationship between the rod and the coil to provide a signal representing the position of the tab, said bracket having a first opening through said bracket providing fluid communication from the interior of said cylinder through said bracket for attachment of a fluid line through the transom of the boat, said bracket having a second opening extending from the interior of said cylinder through said bracket, said coil having lead wires extending through said second opening, and means holding said lead wires in position in the bracket.

5. The system set forth in claim 4 wherein said tubular shaft having a tubular opening having a base at one end, said rod being floating and the lower end of said rod engaging the base of the tubular opening of the shaft.

6. A trim tab indicator system comprising a pair of trim members hinged to the stern of a boat, one on each side of the center line of the boat, a hydrualic cylinder individual to each trim member having a first head at one end attached to a trim member and a second head at the other end, a tubular shaft connected to a piston and extending through the one end of the cylinder at the first head, a bracket having a surface complementary to the transom of the boat and adapted to be mounted on the transom of the boat, sensing means within said cylinder for sensing and providing a signal representing the position of said tab, said bracket having an opening therethrough, and lead wires on said sensing means extending through said opening in said bracket to the exterior of said cylinder so that the wires may be extended through the transom of the boat.

7. The system set forth in claim 6 wherein said sensing means comprises a tubular coil and a rod of magnetic material movable with said piston, an oscillator coupled to said coil so as to provide a periodic output signal having a frequency which varies with position of said rod in said coil, means coupled to said oscillator and responsive to said frequency variations to provide a drive signal indicative of said rod position, and display means responsive to said drive signal for indicating position of said trim tab.

8. The system set forth in claim 7 wherein said oscillator-coupled means includes means for storing high and low values of said drive signal as drive signal limits and for interpolating variations in said drive signal between said limits.

9. The system set forth in claim 8 wherein said oscillator-coupled means comprises means for periodically sampling oscillator output frequency.

* * * * *